United States Patent [19]

Maillet

[11] 4,183,238

[45] Jan. 15, 1980

[54] DOUBLE ACTING PRECISION DEEP-STAMPING PRESS

[75] Inventor: Edgard J. Maillet, Blanquefort, France

[73] Assignee: Agence Nationale de Valorisation de la Recherche (ANVAR), Neuilly sur Seine, France

[21] Appl. No.: 971,758

[22] Filed: Dec. 21, 1978

Related U.S. Application Data

[63] Continuation of Ser. No. 651,440, Jan. 22, 1976, abandoned.

[30] Foreign Application Priority Data

Jan. 24, 1975 [FR] France ..... 75 02291

[51] Int. Cl.[2] ..... B21D 22/28

[52] U.S. Cl. ..... 72/349; 72/481

[58] Field of Search ..... 72/336, 348, 349, 481; 113/120 H

[56] References Cited

U.S. PATENT DOCUMENTS

| | | | |
|---|---|---|---|
| Re. 20,009 | 6/1936 | Hothersoll | 113/120 H |
| 1,453,652 | 5/1923 | Auble | 113/120 H X |
| 3,453,848 | 7/1969 | Williamson | 72/351 X |
| 3,707,086 | 12/1972 | Berg | 72/349 |
| 3,733,879 | 5/1973 | Brown et al. | 72/349 X |

*Primary Examiner*—Leon Gilden

*Attorney, Agent, or Firm*—Edwin E. Greigg

[57] ABSTRACT

A double-acting press for precision deep-stamping requiring a plurality of passes comprises two tool assemblies arranged coaxially facing one another. The first tool assembly is constituted by a hollow stem double-acting hydraulic stamping jack, the head of which contains a cascade of annular dies, one for each pass required, of internal size decreasing from the first pass die situated at the free end of the head. The first pass die bears on its front leading surface the male blank-cutting punch and the spacing of the leading surfaces of two successive dies is at least equal to the height of the blank after its passage through the first of said two dies. A second hydraulic jack, called a central jack whose body is fast to and coaxial with that of the stamping jack has its stem passing coaxially through the hollow stem and the head of the latter. The second tool assembly is constituted by a plurality of coaxial tubular punches, one for each die, conjugated respectively with the male blank-cutting punch and the successive dies until the penultimate die. These tubular punches slide within one another around a central punch for the last pass whose end is arranged to cooperate with that of the stem of the central jack to grip the central part of the blank firmly throughout the forming process. The central jack of the first tool assembly is a double-acting jack while the tubular punches of the second tool assembly are constituted by telescopic tubular pistons of a same jack, called a single-acting hydraulic retaining jack. The central punch of the last pass is a fixed central stem. The tubular pistons are arranged to present their free ends at the level of the end of the fixed central stem when the retaining jack is at the end of its active stroke.

2 Claims, 3 Drawing Figures

8
9
6d
6c
2
6b
10
6a
7
22
20
19a
19b
19c
19d
3
11
14a
13
14b
14c
14d

DOUBLE ACTING PRECISION DEEP-STAMPING PRESS

This is a continuation of application Ser. No. 651,440 filed Jan. 22, 1976 now abandoned.

BACKGROUND OF THE INVENTION

1. Field of the Invention

The invention relates to oleopneumatic presses for precision deep-stamping.

Industry consumes a very large number of small, deep cups and caps of metal, whose sizes are fixed with very small tolerances. By way of example, the cups for small rechargeable batteries may be mentioned, as well as transistor caps. In addition, the surface condition of these parts must not be altered, all the more since they are very often formed from nickel plated strip steel for example. Therefore these parts are stamped by expansion or pressing methods.

2. Description of the Prior Art

The depth of the stamping necessitates several successive passes and hitherto such mass production manufacture was effected on a machine called a "transfer press" which was generally oleopneumatic and comprised a plurality of work stations. The cutting out of the blank is done at the first station and the successive passes at the following stations, whilst a gripping and transportation device provided between each station and the next one ensures the transfer of the blank or rough-shaped element from one to the other at the end of each part of the operation, the movements of the various members being coordinated by a central control desk which comprises an electronic or electromagnetic programmer. This is why stamping requiring four passes is done on a machine including five working stations and four transfer devices. Such a machine has enormous bulk and represents a very high investment.

It is obvious that to obtain a suitable concatenation of the successive operations, a long and meticulous adjustment of the programmer must be undertaken, recommencing every time that there is a change of tooling to pass from one type of stamping to another.

Each working station includes a jack and consumes energy; and each transfer device consumes energy.

OBJECTS AND SUMMARY OF THE INVENTION

It is an object of the present invention to provide a much lighter and compact press representing about one tenth the volume, the weight and the power necessary with respect to a conventional transfer press having the same production capacity.

It is another object of the invention to provide a machine for forming a single type of stamping but with a cost price sufficiently low for the replacement of a transfer press by several compact presses to represent a tremendous economy, as will be explained below.

It is another object of the invention to provide a double acting deep drawing precision press which permits a great economy in energy and which can operate simultaneously and thus multiply the production rate.

It is a further object to provide a stamping press in which the various dies are presented successively to the blank without the latter being transferred from one station to another.

Presses comprising two relatively movable coaxial tool assemblies are known. They are used to produce stampings allowing large tolerances (such as draw stamping of food cans) since they do not permit the obtaining of a firm grip of the central portion of the blank during the whole duration of the stamping process. However, this indispensable condition for precision stampings is respected in the Klocke press (U.S. Pat. No. 2,289,199) but in this press the reverse movements of the dies and of the central punch necessarily limit the number of passes to two.

According to the invention there is provided a double-acting press for precision deep-stamping requiring a plurality of passes which comprises two tool assemblies, arranged coaxially facing one another, the first assembly being constituted, on the one hand, by a jack, called a hollow stem double acting hydraulic stamping jack, in the head of which are arranged in cascade a plurality of annular dies equal in number to that of the passes necessary and of internal sizes decreasing from the first pass die situated at the free end of said head, said first pass die bearing on its front leading surface the male punch for cutting out the blank and the separation of the leading surfaces of two successive dies being at least equal to the height of the rough-shaped element after its passage through the first of the two dies concerned, and, on the other hand, by a second hydraulic jack, called a central jack whose body is fast and coaxial with that of the stamping jack and whose stem passes coaxially through the hollow stem and the head of the latter, whilst the second tool assembly is constituted by a plurality of coaxial tubular punches equal in number to that of the dies of the first assembly, conjugated respectively with the male punch for cutting out the blank and the successive dies up to the penultimate one, said tubular punches sliding in one another around a central punch for the last pass whose end is adapted to cooperate with that of the stem of the central jack of the first assembly to grip firmly the central portion of the blank to be stamped during the whole duration of the forming process. This press is characterised in that the central jack of the first tool assembly is a double-acting jack whilst the tubular punches of the second tool assembly are constituted by telescopic tubular pistons of a same jack, called a single-acting hydraulic retaining jack, that the central punch of the last pass is constituted by a fixed central stem and that said tubular pistons are arranged so that they present their free ends at the level of the end of the fixed central stem when the retaining jack is at the end of its active stroke.

BRIEF DESCRIPTION OF THE DRAWINGS

The invention will be better understood on reading the description which follows with reference to the accompanying drawings in which.

The foregoing Figures are diagrams which illustrate the assembly and operation of a press according to the invention, but the embodiment described in conjunction therewith, is purely by way of example and not to be regarded as in any way limiting.

DESCRIPTION OF A PREFERRED EMBODIMENT

Figure 2:
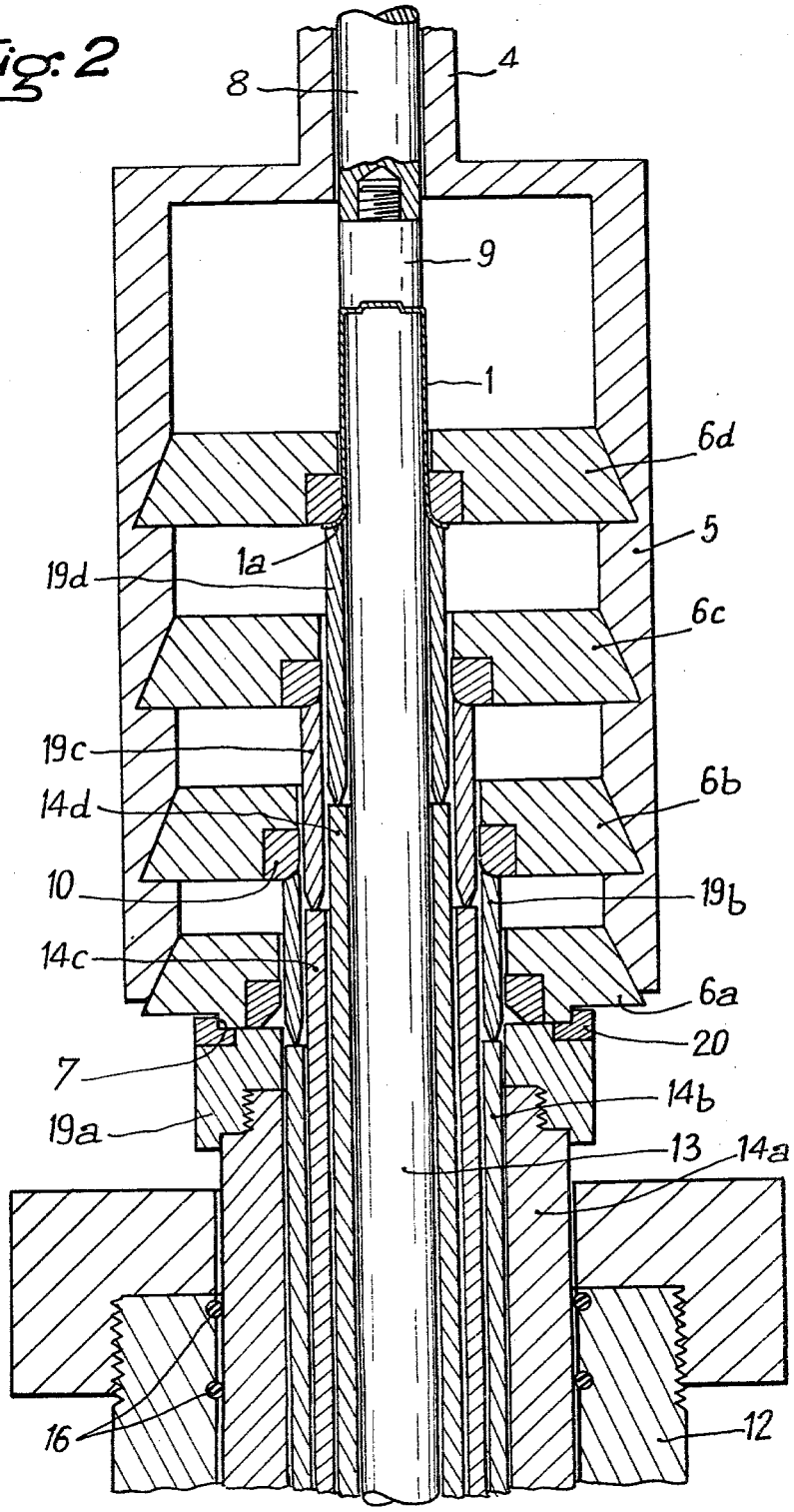
FIG. 2 shows the relative position of the tools of the embodiment of FIG. 1 at the end of the stamping operation and before ejection.

The embodiment shown relates to a vertical press for stamping a deep cylindrical cup such as appears in section under reference number 1 in FIG. 2.

Figure 1:
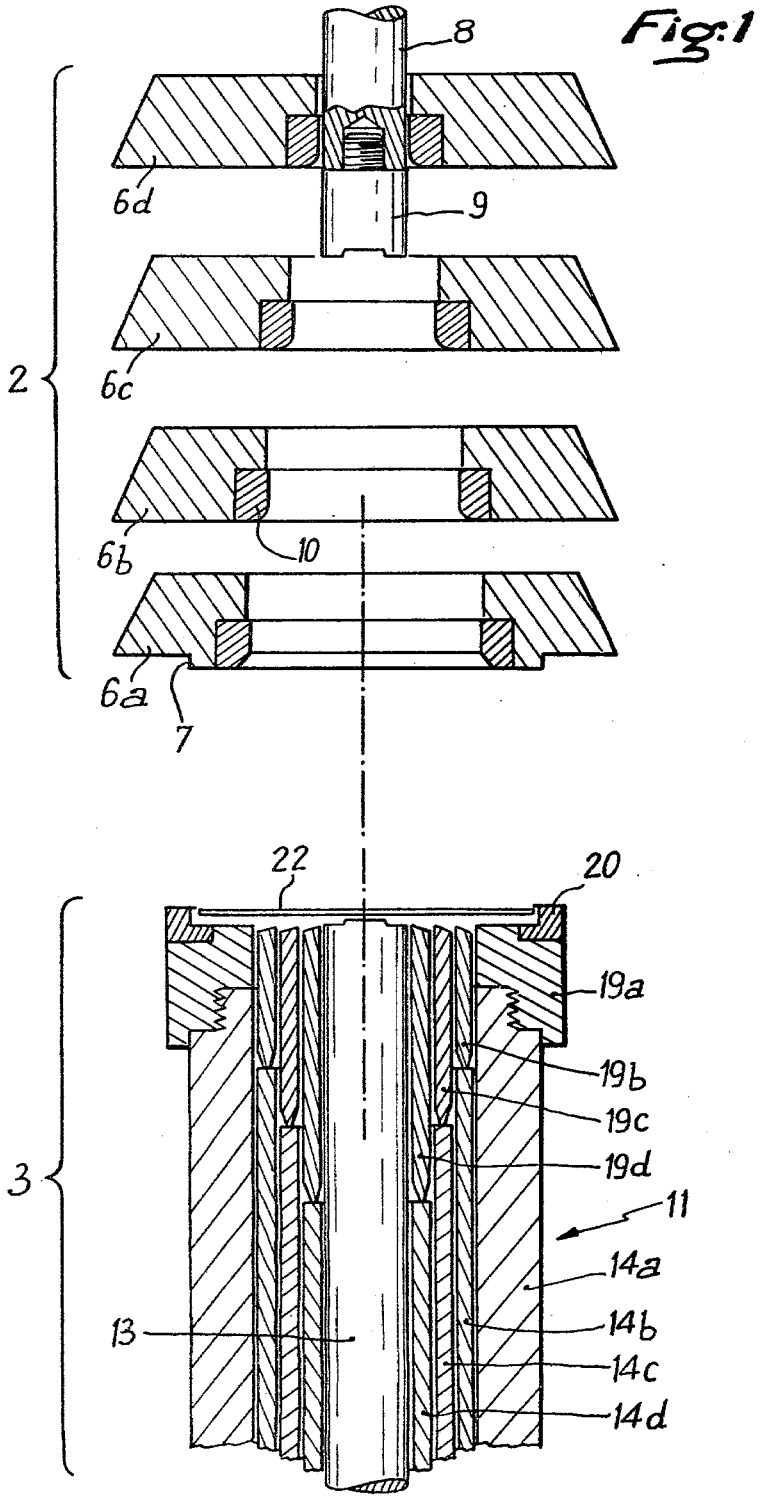
FIG. 1 is a diagram showing the relative position of the tools of one embodiment of a press according to the invention at the beginning of a cycle.

The press includes an upper tool assembly 2 and a lower assembly 3 arranged coaxially (FIG. 1). The upper assembly 2 comprises two double-acting hydraulic jacks, one called a stamping jack and the other called a central jack, of which only the stems (or rams) are visible in the drawing (see FIG. 2).

The stem 4 of the stamping jack is a hollow rod fast to a head 5, also hollow, in which are arranged in cascade, a plurality of annular dies equal in number to that of the passes required. In the examples shown these dies are four in number, referenced *6a, 6b, 6c* and *6d*, the die *6a* situated at the free end of the head 5 being the die of the first pass. In this example each die has the shape of a true ring, the cup 1 being cylindrical, but it should be well understood that the expression "annular die" is intended in its widest sense of a part having a central opening homothetic with the (or, for the die of the last pass, identical with the) contour of the cross-section of the cup to be obtained. The separation of the leading surfaces (here the lower surfaces) of two successive dies is calculated so as to be at least equal to the height of the rough-shaped element after its passage through the first of the two dies concerned. On the leading surface of the die *6a* of the first pass, a step 7 constitutes the male punch for cutting out the blank. The bore of each die is bounded towards the leading surface by an entry ring such as 10 which can be easily replaced.

Inside the hollow stem 4 and head 5 the rod 8 of the central jack slides freely. On this rod 8 a tool 9 is fixed removably, its front surface having dimensions and bearing the impression of the outer surface of the bottom of the cup to be obtained.

Figure 3:
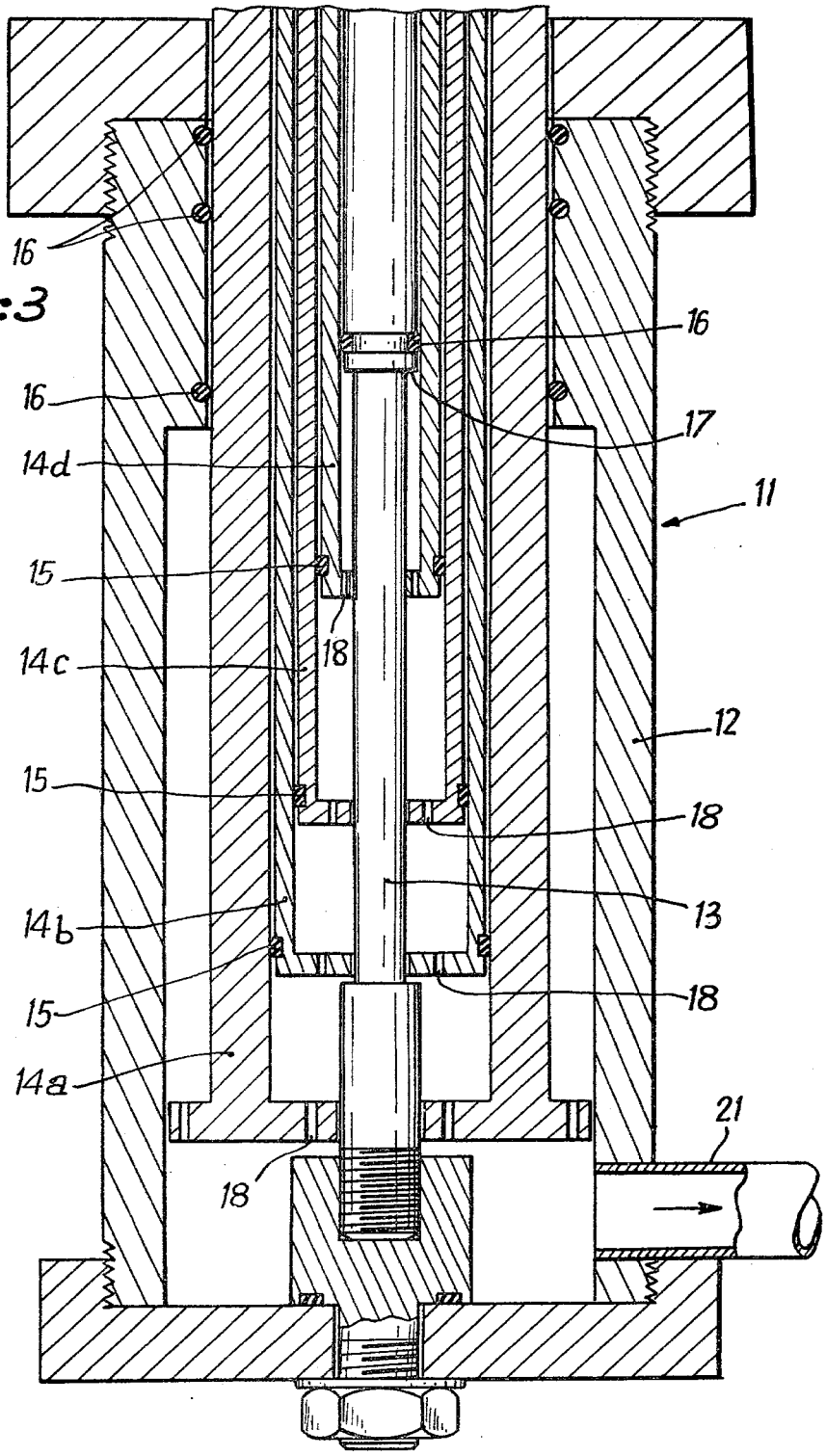
FIG. 3 shows the arrangement of the retaining jack.

The lower assembly 3 comprises a single acting hydraulic jack 11 called "retaining jack" (FIGS. 1, 2 and 3). This jack 11 has a body 12 traversed axially by a fixed rod 13 firmly fixed on the bottom of the body 12 which it traverses in fluid-tight manner. Around the rod 13, nested in one another, slide a plurality of tubular pistons equal in number to that of the dies of the assembly 2, namely in the example, four tubular pistons *14a, 14b, 14c* and *14d*. Each tubular piston *14b, 14c* and *14d* is provided with a fluid-tight seal 15 which is adapted to it and other seals 16 arranged on the lateral surface of the rod 13 and on the inner lateral surface of the body 12 ensuring fluid-tightness towards the outside. At its lower end each tubular piston comprises a collar directed inwardly which grip around the rod 13, whose diameter is reduced over the whole height corresponding to the stroke of the pistons. This part of least diameter is connected to the upper part of the rod 13 to a shoulder 17 which constitutes the upper end of stroke stop for the piston *14d*, each of the other pistons coming into abutment against the collar of the nearest piston towards the inside. Advantageously each collar bears on its lower surface bosses (not shown) which avoids two successive pistons "sticking" at the upper stop. The collars include perforations 18 for the passage of oil. It is clear that the choice of the value of the annular surface of each collar, without perforations, enables the retaining force of the corresponding piston to be determined precisely as a function of the common hydraulic pressure existing inside the body 12.

The free end of the rod 13 constitutes the central punch of the press, its front surface has the dimensions and presents the impression of the inner surface of the bottom of the cup to be produced and it is designed to cooperate with the tool 9 borne by the rod of the central jack of the assembly 2. On each tubular piston is arranged a tool, *19a, 19b, 19c* and *19d* respectively, which are axially hollow. These tools nest within one another and present their free ends at the level of the free end of the rod 13 when the pistons are in upper abutment (see FIG. 1). Each tool has internal dimensions conjugated with the internal dimensions of the corresponding die and external dimensions conjugated with the internal dimensions of the preceding die. The tool *19a* borne by the outer tubular piston *14a* bears on its leading surface the female punch 20 for cutting out the blank, designed to cooperate with the step 7 of the first pass die *6a*.

Advantageously the chamber of the hydraulic stamping jack which is opposite the stem or hollow rod 4, that is to say, the active chamber, is connected to a pressure transformer supplied with compressed air by a reservoir of large volume and devoid of an air exhaust such as that described in Applicant's co-pending application No. 514,084, the other chamber of the stamping jack being connected, for the return, to a hydraulic motor pump unit.

In the same way, to the pipe 21 supplying the retaining jack chamber intermittently is advantageously connected in by-pass between the jack and the controlling electrovalve, an oleopneumatic pressure regulator such as that described in Applicant's above-mentioned application No. 514,085.

The stamping procedure is as follows, starting from the position corresponding to FIG. 1, that is to say the pistons of the retaining jack being in upper abutment, a metal sheet covering the free ends of the tools *19a, 19b, 19c* and *19d* and the fixed rod 13, the stamping jack and the central jack being also in upper position:

(a) descent of the ram of the stamping jack. The die *6a* of the first pass comes into abutment against the tool *19a* and the step 7 cooperates with the punch 20 to cut out a blank 22, circular in this case.

(b) descent of the ram of the central jack. The tool 9 borne by the rod 8 of said jack becomes applied against the blank 22 which it flattens against the end of the fixed rod 13 and impresses on the center of said blank the requisite impression of its front surface. The tool 9 remains in this position until the end of the last pass. At this stage the blank is firmly gripped at its center between the rod 13 and the tool 9 which plays the role of upper blank-press and at its periphery between the lower surface of the die *6a* and the free end of the tool *19a* which plays the role of lower blank-press.

(c) the head 5 of the stamping jack continues its stroke driving the tubular piston *14a* downwardly. A portion of the oil of the retaining jack is driven back to the oleopneumatic regulator but the pressure inside said jack does not vary substantially. During the descent of the head 5 the assembly formed by the tools *19b, 19c, 19d* and the end of the jack 13 constitute the punch of the first pass and cooperate with the die *6a* to convert the blank into a first rough-shaped element which is finished when its edge escapes from the grip of the tool *19a*.

(d) the die *6b* arrives in contact with the peripheral zone of the bottom of the rough-shaped element and grips it against the tool *19b* which then plays the role of lower blank-press, whilst the assembly formed by the rod 13 and the tools 19*c* and 19*d* constitute the punch of the second pass.

(e) the same operations are repeated for the following passes until the last, here the fourth, corresponding to the position shown in FIG. 2. For this last pass the punch is constituted only by the rod 13.

(f) the descent of the head 5 is stopped before the edge 1*a* of the flange of the top 1 escapes from the blank grip 19*d* (see FIG. 2).

(g) an electro-valve closes the circuit between the retaining jack and the oleopneumatic regulator to prevent the lifting of the tubular pistons.

(h) re-ascent of the dies.

(i) re-ascent of the rod 8 of the central jack.

(j) opening of the retaining jack electro-valve.

The tubular pistons are brought back to their upper abutment position and the piston 14*d* ejects the stamped element by the tool 19*d* which acts on the collar flange 1*a*.

(k) the sheet metal advances one step and the cycle can recommence.

The tools 9, 19*a*, 19*b*, 19*c*, and 19*d* can be replaced easily and immediately after wear. The replacement of the entry rings 10 of the dies is also easily effected.

A press such as that which has just been described is designed and calculated (pressures applied, annular surfaces of the tubular pistons, separation of the dies, etc . . . ) for a particular type of stamping according to the characteristics of the material to be stamped, whilst on a conventional transfer press it is possible to pass from one type of stamping to another by changing the tooling and modifying the adjustment. Inspite of this difference, the use of presses according to the invention represents a very considerable economy.

In fact, taking for a unit the cost of tooling a transfer press, the latter costs 16 to 20 units, whilst for the same production capacity, the axial press according to the invention costs (tooling included) about 2.5. That is to say that for the same investment of 25, it is possible to have ten axial presses ($2.5 \times 10$) or one transfer press with ten sets of tooling ($16+10$). However, of course, the ten axial presses can, themselves, operate simultaneously. The economy is hence considerable, without even taking into account the fact that the change of tooling on the transfer press causes an enormous loss of time for the adjustment which necessitates several hours on each occasion.

If the economy in the investment is very great, the economy of operation is not less so. For a particular manufacture an oleopneumatic transfer press operating with a compressor of 200 HP can be replaced for the same capacity of production, by an axial press operating with a motor pump unit of 20 HP.

I claim:

1. A double-acting press for precision deep-stamping requiring a plurality of passes, comprising first and second tool assemblies, arranged in coaxial relationship facing one another and wherein the common axis of said first and second tool assemblies is vertical, said first tool assembly comprising a hollow stem, double-acting hydraulic stamping jack including a head having a free end, a plurality of angular pass dies equal in number to that of the passes required supported on said stamping jack head and having internal dimensions decreasing from the first pass die situated at the free end of said head, a male blank-cutting punch on the front leading surface of said first pass die, the spacing of the leading surfaces of two successive pass dies being at least equal to the height of the blank after it passes through the first of a pair of adjacent dies, a second hydraulic central, double-acting jack having a stem, said central jack being disposed in coaxial, operative relationship with said stamping jack with said stem passing coaxially through the hollow stem and the head of the stamping jack, said second tool assembly comprising a single-acting hydraulic retaining jack and including a plurality of coaxially arranged, telescopically disposed tubular punches equal in number to that of the pass dies of said first tool assembly aligned, respectively, with said male blank-cutting punch and the successive dies until the penultimate die, a central punch having a fixed central stem disposed within said tubular punches for the last pass whose end is arranged to cooperate with that of the stem of said central jack of said first tool assembly to grip the central part of the blank firmly during the entire deep-stamping process, said tubular punches being arranged to slide within one another around said central punch, said tubular punches including a plurality of telescopically arranged tubular pistons operatively associated with a respective one of said tubular punches, a plurality of interchangable tubular tools forming a working surface for the upper part of a respective one of said tubular punches, said interchangable tubular tools bearing on a corresponding respective tubular piston, said tubular punches being arranged so that they present their free ends at the level of the end of said fixed central stem of said central punch when said retaining jack is at the end of its active stroke.

2. A double-acting press according to claim 1 wherein the free end of the stem of said central jack comprises fixing means for an interchangable tool, said interchangable tool having a front surface for supporting a male or female impression aligned with a female or male impression supported by the end of the fixed central stem of said second tool assembly.

* * * * *